United States Patent [19]

Price et al.

[11] 4,290,177

[45] Sep. 22, 1981

[54] AIR JET WITH A BAFFLE INCLUDING AN ARCUATE YARN ENGAGING SURFACE

[75] Inventors: Samuel T. Price, Kennett Square; Kay P. Hoffsommer, Ridley Park, both of Pa.

[73] Assignee: Enterprise Machine and Development Corp., New Castle, Del.

[21] Appl. No.: 87,729

[22] Filed: Oct. 24, 1979

[51] Int. Cl.[3] ..... D02G 1/16

[52] U.S. Cl. ..... 28/254; 28/272; 28/273

[58] Field of Search ..... 28/254, 273, 257, 272

[56] References Cited

U.S. PATENT DOCUMENTS

| | | | |
|---|---|---|---|
| 2,812,850 | 11/1957 | Pape | 28/272 X |
| 3,156,028 | 11/1964 | Weiss et al. | 28/257 |
| 3,453,709 | 7/1969 | Dyer | 28/254 X |
| 3,656,214 | 4/1972 | Ozawa et al. | 28/257 |
| 3,700,391 | 10/1972 | Pike | 28/254 X |
| 3,800,374 | 4/1974 | Ozawa et al. | 28/257 |
| 3,822,543 | 7/1974 | Edagawa et al. | 28/254 X |
| 3,881,231 | 5/1975 | Price et al. | 28/254 |
| 4,183,123 | 1/1980 | Tanaka et al. | 28/254 X |
| 4,187,593 | 2/1980 | Price | 28/254 |

FOREIGN PATENT DOCUMENTS

| | | | |
|---|---|---|---|
| 2420332 | 11/1975 | Fed. Rep. of Germany | 28/257 |
| 49-18493 | 5/1974 | Japan | 28/257 |
| 51-55451 | 5/1976 | Japan | 28/257 |

*Primary Examiner*—Robert Mackey

*Attorney, Agent, or Firm*—Bell, Seltzer, Park & Gibson

[57] ABSTRACT

The air jet of the present invention is of the "bullet nose" type and is provided with a conical outer surface (32) on the exit end for directing the ambient air surrounding the exit end of the jet downwardly and inwardly to join the yarn and pressurized air leaving the exit orifice (22) of the jet. An "airfoil" type baffle (40) is spaced from the exit orifice (22) and includes an arcuate leading surface (41) positioned to be engaged by the yarn and pressurized air after leaving the exit orifice (22) and a substantially wedge-shaped portion extending away from the arcuate leading surface (41) and being defined by the converging upper and lower planar surfaces (43, 44). The baffle (40) is supported for adjustment to vary the downstream distance and the perpendicular position relative to the exit orifice (22).

5 Claims, 4 Drawing Figures

AIR JET WITH A BAFFLE INCLUDING AN ARCUATE YARN ENGAGING SURFACE

FIELD OF THE INVENTION

This invention relates generally to an air jet for treating multifilament yarn and more particularly to an air jet which includes a frusto-conical outer surface on the exit end and a baffle with an arcuate leading surface spaced from the exit orifice of the air jet and positioned for engagement by the yarn and pressurized air leaving the air jet.

BACKGROUND OF THE INVENTION

It is generally known to utilize various types of air jets to interlace and/or texture one or more ends of multifilament yarn. These known types of air jets are provided with an elongate housing which is of substantially the same diameter throughout the length from the entrance to the exit end so that the exit end is flat. As the yarn and pressurized air leaves the exit orifice of this type air jet, the ambient air surrounding the exit end of the jet is drawn inwardly around the flat exit end of the jet and forms a circular area of low pressure around and adjacent the exit orifice. This low pressure area surrounding the exit orifice tends to open up and separate the filaments of the yarn leaving the air jet so that a large quantity of air must be supplied to the air jet to achieve the desired amount of interlacing or texturing of the yarn.

It is also known to utilize various types of baffles adjacent the exit end of an air jet to permit increased texturing speeds and to enhance the crimps, curls and loops imparted to the yarn in the turbulence chamber of the air jet. These baffles are adapted to be engaged by and deflect the yarn as well as the air leaving the exit orifice of the air jet. U.S. Pat. No. 3,881,231 discloses and describes the advantages of the use of a cylindrical baffle positioned adjacent the exit orifice of a yarn texturing air jet. U.S. Pat. No. 4,148,116 discloses and describes the advantages of the use of a planar baffle positioned adjacent the exit orifice and including an opening through which the yarn passes. The baffles of both of these patents are disclosed in use with yarn texturing air jets which have flat exit ends of substantially the same diameter as the diameter of the elongate housing of the air jet.

SUMMARY OF THE INVENTION

With the foregoing in mind, it is an object of the present invention to provide the exit end of an air jet with a "bullet nose" configuration in the form of a frusto-conical outer surface to provide air guiding means for causing the ambient air to be drawn downwardly along the frusto-conical surface and join the pressurized air and yarn leaving the exit orifice of the air jet. A baffle is spaced from the exit end of the air jet and includes an arcuate leading surface in the form of an arc of a circle positioned to be engaged by the yarn and pressurized air leaving the exit orifice. The baffle also includes a substantially wedge-shaped portion extending away from the arcuate leading surface to provide an "airfoil" type of baffle.

The use of the "bullet nose" jet with the "airfoil" baffle permits higher operating speeds while consuming a smaller quantity of pressurized air. The path of travel of the ambient air down the frusto-conical surface of the exit end of the air jet tends to cause the filaments to be maintained together, rather than being drawn apart, so that the homogeneous quality of the yarn is enhanced and the yarn exhibits a tighter yarn cross-section bundle.

In accordance with the present invention, the smaller end of the frusto-conical outer surface on the exit end of the housing extends from a position closely surrounding the exit orifice and the cross-sectional diameter of the exit end of the jet is not substantially greater than three times the cross-sectional diameter of the exit orifice. The frusto-conical outer surface extends from the exit end and its base is positioned at substantially the midpoint of the housing of the jet and at an angle of from about 25 to 35 degrees, preferably 28 degrees, relative to the longitudinal axis of the air jet.

The "airfoil" baffle includes first adjustment support means for varying the downstream distance between the arcuate leading surface and the exit orifice of the air jet. Second adjustment support means is also provided for varying the perpendicular or vertical position of the arcuate leading surface of the baffle relative to the exit orifice of the air jet. The arcuate leading surface of the baffle comprises an arc of a circle with the chord of the arc being positioned at an angle of more than 90 degrees relative to the longitudinal axis of the housing of the air jet.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
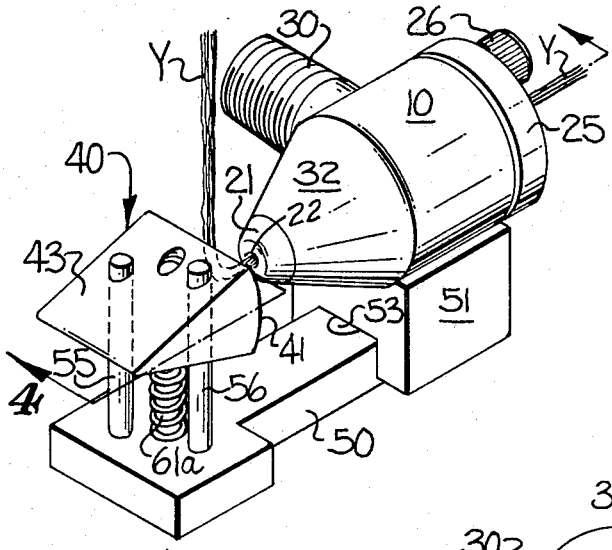
FIG. 1 is an isometric view looking downwardly on the air jet of the present invention and illustrating the "airfoil" baffle supported adjacent the exit orifice thereof.
Figure 2:
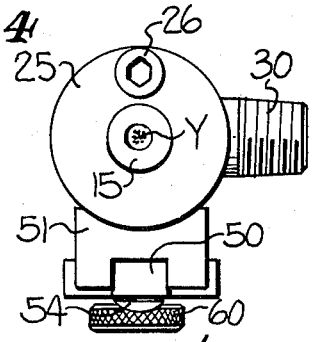
FIG. 2 is an elevational view looking at the right-hand end of FIG. 1.
Figure 3:
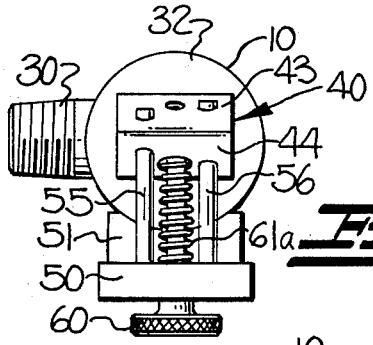
FIG. 3 is an elevational view looking at the left-hand end of FIG. 1.

The "bullet nose" air jet of the present invention includes an elongate housing 10 having a central bore 11 extending therethrough and being slightly reduced adjacent the exit end. A yarn guiding needle 14 is positioned for longitudinal adjustment and sliding movement in the central bore 11 of the housing 10 and the outermost main body portion of the needle 14 is of the same diameter as the central bore 11. The outer or entrance end of the needle 14 is provided with a ceramic yarn guide 15 which defines the entrance end of a yarn passageway 16 extending along the longitudinal axis of the housing and through the needle 14. The needle 14 is provided with a reduced portion 17, an enlarged ring or flange 18 and a nose portion 20 including an inwardly tapered inner end. The inner end of the needle 14 defines the entrance end of a turbulence chamber in the air jet.

A venturi 21 is supported in the exit end of the housing 10 and in the reduced portion of the central bore 11. An exit orifice 22 is provided in the exit end of the venturi 21 and the exit end of the venturi extends outwardly beyond the exit end of the housing 10 and forms an extension thereof, in a manner to be presently described. An inwardly tapered conical inner wall 23 is provided in the venturi 21 and defines the exit end of the turbulence chamber in the air jet.

A collar 25 of substantially the same diameter as the main body of the housing 10 is fixed on the outer end of the needle 14. A shoulder screw 26 extends through the collar 25 and is threadably supported at its inner end in the housing 10 (FIG. 4) so that the inner end of the needle 14 can be adjusted relative to the venturi 21 by rotation of the shoulder screw 26. Air under pressure is introduced into the central bore 11 through an air pressure inlet nipple 30 which is suitably connected to a suitable source of pressurized air, not shown. Air pressure entering the bore 11 through the nipple 30 is introduced in the area of the annular reduced portion 17 of the needle 14 and moves forwardly along the needle to pass through the venturi 21 and out the exit orifice 22. The air pressure normally maintains the needle 14 in the outermost position shown in FIG. 4 with the collar 25 against the shoulder screw 26.

In accordance with the present invention, the exit end of the housing 10 of the jet is provided with air guiding means, in the form of a frusto-conical outer surface 32. The frusto-conical outer surface 32 on the exit end of the housing 10 directs the path of travel of the ambient air surrounding the exit end of the housing downwardly and along the frusto-conical outer surface 32 so that it joins the pressurized air and the yarn leaving the exit orifice, as indicated by the arrows in FIG. 4. This is in contrast to the normal path of travel of the ambient air surrounding the exit end of a conventional type of air jet with a flat end.

The inwardly tapering frusto-conical outer surface 32 on the exit end of the housing 10, and the mating frusto-conical surface on the venturi 21, of the jet causes the ambient air surrounding the exit end of the air jet to be drawn inwardly to surround and compress the yarn as it leaves the exit orifice 22. The frusto-conical outer surface 32 is inclined inwardly at an angle of from about 25 to 35 degrees and is illustrated as being 28 degrees relative to the longitudinal axis of the air jet. The mating frusto-conical outer surface 32 of the housing 10 and the venturi 21 is economically formed by simply turning the housing 10 and the venturi 21 in a metal lathe.

The frusto-conical outer surface 32 closely surrounds the exit orifice 22 and extends rearwardly to substantially the midpoint of the housing 10. The cross-sectional diameter of the exit end of the housing is not substantially greater than three times the cross-sectional diameter of the exit orifice 22 of the venturi 21 so that a smooth flow of ambient air moves down the frusto-conical outer surface 32 and joins the yarn and pressurized air leaving the exit orifice 22.

Figure 4:
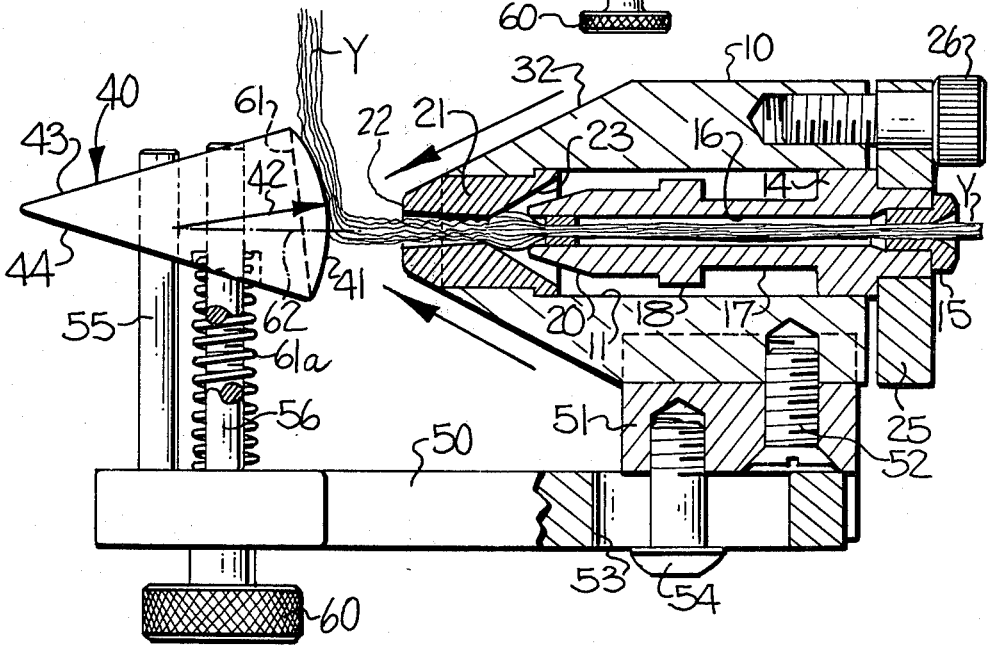
FIG. 4 is an enlarged longitudinal sectional view taken substantially along the line 4—4 in FIG. 1.

The "airfoil" baffle of the present invention, broadly indicated at 40, includes an arcuate leading surface 41 which comprises an arc of a circle having a constant radius indicated by the arrow 42 in FIG. 4. The baffle 40 also includes a substantially wedge-shaped portion extending away from the arcuate leading surface 41 and being defined by respective upper and lower planar surfaces 43, 44 which substantially converge together at their outer ends.

First adjustment support means is provided for varying the downstream distance between the arcuate leading surface 41 of the baffle 40 and the exit orifice 22 of the air jet. The first adjustment support means comprises a support bracket 50, one end of which is supported for longitudinal sliding movement in a slot in the lower surface of a mounting block 51. The mounting block 51 has an arcuate upper surface which is fixed to the lower surface of the main portion of the jet housing 10 by a screw 52 (FIG. 4). The support bracket 50 is longitudinally slotted as at 53 and is maintained in longitudinally adjusted position by a screw 54 which penetrates the slot 53 and is threadably imbedded in the support block 51.

Second adjustment support means is provided for varying the perpendicular or vertical position of the arcuate leading surface 41 of the baffle 40 relative to the exit orifice 22. The second adjustment support means comprises a pair of vertical guide pins 55, 56 having upper end portions extending through suitable guide holes in the baffle 40. The lower ends of the guide pins 55, 56 are fixed in the outer free end portion of the support bracket 50. The lower portion of an adjustment screw 60 penetrates the support bracket 50 and the upper end is threadably supported in the baffle 40. A compression spring 61a surrounds the adjustment screw 60 and normally urges the baffle 40 to an uppermost position. Rotation of the adjustment screw 60 selectively raises or lowers the baffle 40, relative to the exit orifice 22 of the air jet.

As is illustrated in FIG. 4, untreated yarn Y enters the needle 14 through the guide 15 and passes through the passageway 16. As the yarn leaves the inner end of the needle 14, it is textured by the air entering the turbulence chamber around the inner end of the needle 14. The textured yarn passes through the venturi 21 and out of the exit orifice 22 and is directed against the arcuate leading surface 41 of the baffle 40. The yarn is then directed upwardly, moving along the upper portion of the face of the arcuate leading surface 41 of the baffle 40 and is directed through guides, not shown, to a suitable take-up package.

The pressurized air which leaves the exit orifice 22 also is directed against and engages the arcuate leading surface 41 and causes the ambient air surrounding the exit end of the air jet to be drawn downwardly along the frusto-conical surface 32, in the direction of the arrows in FIG. 4, and against the baffle 40. As has been pointed out, the arcuate leading surface 41 comprises an arc of a circle having a constant radius and the chord of the arc, indicated by the dotted line 61 in FIG. 4, is positioned at an angle of more than 90 degrees, relative to the longitudinal axis of the air jet, indicated by the dash-dot line 62 in FIG. 4. Thus, the baffle 40 is in effect "tilted" upwardly so that a larger amount of the surface of the arc is above the point at which the yarn and air normally engage the arcuate leading surface 41. It is preferred that the cord 61 of the arc be tilted upwardly and slightly away from the exit orifice 22 so that it defines an angle of substantially 98 degrees with the longitudinal axis 62 of the air jet.

The "bullet nose" configuration provided by the frusto-conical outer surface 32 on the exit end of the air jet housing 10 causes the ambient air surrounding the exit end of the jet to be drawn inwardly to join the pressurized air and yarn leaving the exit orifice of the air jet to aid in maintaining the filaments in compacted condition. The "airfoil" baffle cooperates with the "bullet nose" configuration on the exit end of the air jet to enhance the texturing and permit higher operating speeds to be employed while consuming a smaller quantity of pressurized air.

In the drawings and specification, there has been set forth a preferred embodiment of the invention, and although specific terms are employed, they are used in a generic and descriptive sense only and not for purposes of limitation.

We claim:

1. In an air jet for treating multifilament yarn and including an elongate housing having a central bore therethrough, an entrance end for passage of yarn into said air jet, an exit end including an exit orifice for passage of yarn from said air jet, and means for directing pressurized air into the central bore of said housing to contact the yarn and pass outwardly through the exit orifice with the treated yarn; the combination therewith of air guiding means associated with said exit end of said housing for controlling and directing the path of travel of ambient air surrounding said exit end of said housing, said air guiding means comprising a frusto-conical outer surface on said exit end of said housing and extending from its smaller end positioned closely surrounding said exit orifice toward its base positioned between said exit orifice and said entrance end of said housing so that the pressurized air leaving said exit orifice causes the ambient air surrounding said exit end of said housing to be drawn downwardly along said frusto-conical outer surface and join the pressurized air and yarn leaving said exit orifice of said air jet, and including a baffle spaced from said exit orifice, said baffle comprising an arcuate leading surface positioned to be engaged by the yarn and pressurized air after leaving said exit orifice, and a substantially wedge-shaped portion extending away from said arcuate leading surface.

2. An air jet according to claim 1 wherein said base of said frusto-conical outer surface is positioned substantially at the midpoint of said housing, and wherein the cross-sectional diameter of said smaller end of said frusto-conical surface is not substantially greater than three times the cross-sectional diameter of said exit orifice.

3. An air jet according to claim 1 including first adjustment support means for varying the downstream distance between said arcuate leading surface of said baffle and said exit orifice of said air jet.

4. An air jet according to claim 1 including second adjustment support means for varying the perpendicular position of said arcuate leading surface of said baffle relative to said exit orifice of said air jet.

5. An air jet according to claim 1 wherein said arcuate leading surface of said baffle comprises an arc of a circle, the chord of said arc being positioned at an angle of more than 90 degrees relative to the longitudinal axis of said housing of said air jet.

* * * * *